United States Patent [19]

Reist

[11] 4,347,694

[45] Sep. 7, 1982

[54] METHOD OF INTERCONNECTING AND MANIPULATING PRINTED PRODUCTS

[75] Inventor: Walter Reist, Hinwil, Switzerland

[73] Assignee: Ferag AG, Hinwil, Switzerland

[21] Appl. No.: 126,424

[22] Filed: Mar. 3, 1980

[30] Foreign Application Priority Data

Mar. 9, 1979 [CH] Switzerland ..... 2270/79

[51] Int. Cl.[3] ..... B65B 15/04

[52] U.S. Cl. ..... 53/399; 53/414; 53/591

[58] Field of Search ..... 53/399, 414, 135, 591

[56] References Cited

U.S. PATENT DOCUMENTS

| | | | |
|---|---|---|---|
| 2,578,799 | 12/1951 | Grey | 53/591 X |
| 2,889,610 | 6/1959 | Buddecke | 53/591 X |
| 3,357,151 | 12/1967 | Monaghan | 53/591 X |

FOREIGN PATENT DOCUMENTS

| | | | |
|---|---|---|---|
| 2701251 | 7/1978 | Fed. Rep. of Germany | 53/591 |
| 2158747 | 6/1973 | France | 53/591 |

*Primary Examiner*—James F. Coan

*Attorney, Agent, or Firm*—Werner W. Kleeman

[57] ABSTRACT

In order to facilitate the handling or manipulation of products, especially printed products, typically newspapers and magazines or the like, the same are grouped together into a band worm-like, foldable composite formation. As a result, the printed products have imparted thereto, also in their dimensions, a defined identity which can be gainfully employed after a possible intermediate storage during each further processing thereof. At the same time there is facilitated the storage (stacking, palletizing and so forth) and the removal from a storage area as well as the transport thereof, especially since the access to the composite formation renders seizable, in a defined manner, each product which is engaged therefrom.

2 Claims, 9 Drawing Figures

Fig. 1
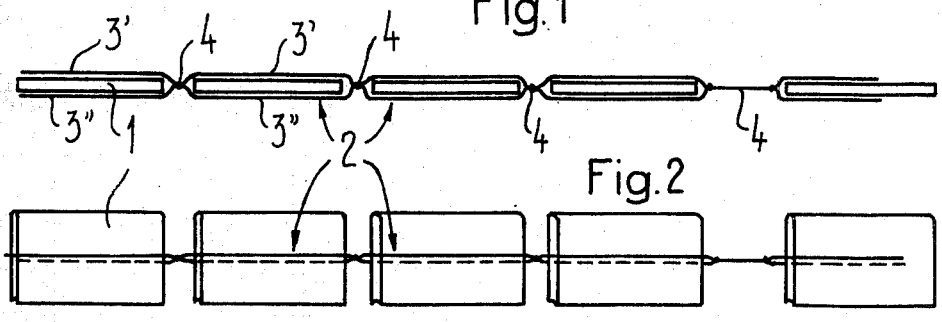
Fig. 2
Fig. 3
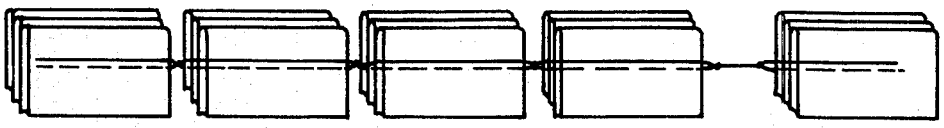
Fig. 4
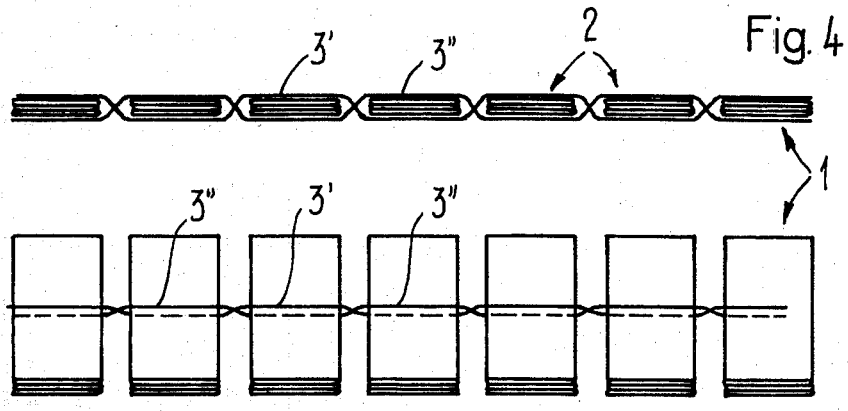
Fig. 5

METHOD OF INTERCONNECTING AND MANIPULATING PRINTED PRODUCTS

BACKGROUND OF THE INVENTION

The present invention relates to a new and improved method of, and apparatus for, the manipulation or handling of products, particularly printed products, such as newspapers and magazines or the like. The invention also relates to a novel use of the inventive method.

During the processing of printed products, such as for instance newspapers and magazines, as the term "processing" is used in its broadest sense, i.e. to include among other things, the transport and storage of such printed products, the latter are frequently present in a more or less loose formation. Thus, for instance, the products can appear in an imbricated product formation or also in the form of a stack. For a great many working operations, it is then necessary to detach the product copies out of the relevant product formation and to then individually infeed the same to the automatic equipment provided for the processing thereof. On the one hand, it is necessary to ensure that the products arrive individually, and there are decisive either the characteristics of the processing machine for the fetching of the products or conversely, the machine must be controlled in accordance with the arrival of the products. At every opportunity it is absolutely necessary to be able to detect the products, then to be able to have them in so-to-speak "control" and to subject the same, in each case, to the momentarily prevailing processing requirements or, if such are governed by the products, then to find out the momentary operating principles which are to be observed. In other words, it can be stated that it is necessary in all instances and at each opportunity to define the products and the operating correlations which are decisive therefore. This requires, particularly when confronted with high processing speeds and products which vary as to their nature, size, contour and so forth, quite an appreciable expenditure, which must not merely be put forth one time, rather for the same product copies, numerous times during the course of their processing. Thus it is for instance clear that the product copies, following each stacking operation, for instance for the purpose of intermediate storage of the products or for the transport prior to further processing, must be once again defined.

SUMMARY OF THE INVENTION

Therefore, with the foregoing in mind, it is a primary object of the present invention to avoid the aforementioned drawbacks and specifically by solving the objective directed to conserving the once ascertained and arrived at definition of the products.

In the first instance, this object is solved in that, during the manipulation of printed products, especially newspapers, magazines, periodicals or the like, the product copies or groups of product copies are connected with one another into a so-to-speak band worm-like foldable structure and are processed in this composite formation. What is decisive is that the products are once and for all clearly defined by virtue of their intercorrelation and until the same is again annihilated, i.e., during their entire processing are once and for all defined. This is even so if a manipulation or handling operation involves the composite product formation. It is possible, for example, to readily convey the products which have been grouped together into their composite formation, with the aid of an "undefined" conveyor device, such as transport bands or belts or the like, from one location to the other, from one machine to another machine, if desired by incorporating therebetween an intermediate storage. In so doing, there is always insured that after each product copy, the next product copy follows at a predetermined spatial and/or timewise spacing, without there existing the danger that the product copies not only arrive irregularly, rather that two or more product copies simultaneously arrive or fail to arrive.

The product copies or groups of product copies can be interconnected with one another by means of at least one flexible pressure element and can be connected with respect to the traction element by the fixation of the product copies or groups of product copies. The traction element can be structured to be thread- or cord-shaped, band-shaped and so forth, or can otherwise possess another random suitable configuration. The product copies or groups of product copies can be also interconnected with one another by tying ropes or cords or the like, which are coherently interconnected and which engage about the product copies or groups of product copies, these tying ropes, in turn, advantageously being formed by means of at least one traction element which extends in the length of the composite formation. Moreover, during the building of the composite formation, the product copy or groups of product copies are advantageously placed in a row adjacent one another and there is applied thereto, from the one or the other side as the case may be, the traction or tension elements which are then interconnected with one another between the product copies or groups of product copies. It is possible to introduce the traction elements so as to cross-over between the product copies or groups of product copies. This also can be accomplished by relative rotation of the product copies.

During the use of this method explained previously in different embodiments, during the stacking, palletizing, storage and so forth of the printed products, which are particularly of significance, the composite formation is folded in a meander-like fashion and the individual fold zones are placed against one another in layers. Thus, during stacking it is possible for neighboring product copies or groups of product copies to be shifted in half relative rotation and the composite formation can be folded between neighboring product copies and so forth, so that the product copies are stacked in a crossed position.

The previously mentioned objective is furthermore carried out with the aid of a novel apparatus for the performance of the above-explained method. The inventive apparatus comprises means for the drawing out of at least one of the traction elements, and additionally conveyor means for placing in a row next to one another the product copies or groups of product copies along the traction element and means for the fixation of the product copies and so forth in relation to the traction element. Advantageously, there are provided means for drawing out at least two traction elements as well as means for introducing the product copies and so forth between the traction elements. For forming a tying of the products the equipment can contain means for connecting at least two traction elements with one another, and such can constitute adhesive means, welding means or the like or, however, means for crossing the traction elements between the product copies and so forth. The latter can contain turning means for the product copies, but also guide means for the traction elements, which are movable transversely with respect to the draw or pulling-out direction. These guide means can be arranged in pairs and can be movable oppositely with respect to one another, and specifically, driven with a rhythm or cycle corresponding to the rhythm or cycle with which the product copies are moved past the guide means.

In order to stack printed products of the type here under discussion, which are interconnected with one another into a band worm-like foldable structure, it is contemplated, according to the teachings of the invention, to design the infeed means for the composite formation, arranged above a stacking or stack support, and the stack support itself to be movable to-and-fro in relation to one another, at least in the infeed direction. In the simplest case, there can be provided a conveyor band or belt which engages over the stack support, this conveyor belt performing to-and-fro movements in the conveying direction, so that the conveyed composite formation is folded and stacked in the manner of endless forms or the like.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 1 and 2 illustrate a composite formation of individual printed products viewed from the side and from the top, respectively, wherein the product copies are oriented with their lengthwise central line at the lengthwise extent of the composite formation;

FIG. 3 schematically illustrates a basically similar composite formation of products, wherein, however, such is not constituted by single product copies, but by groups of product copies;

FIGS. 4 and 5 illustrate a composite formation, formed by groups of product copies, in side and top plan view, respectively, which are aligned such that their lengthwise central line extends transversely with respect to the lengthwise extent of the formation;

DETAILED DESCRIPTION OF THE PREFERRED EMBODIMENTS

Figure 6:
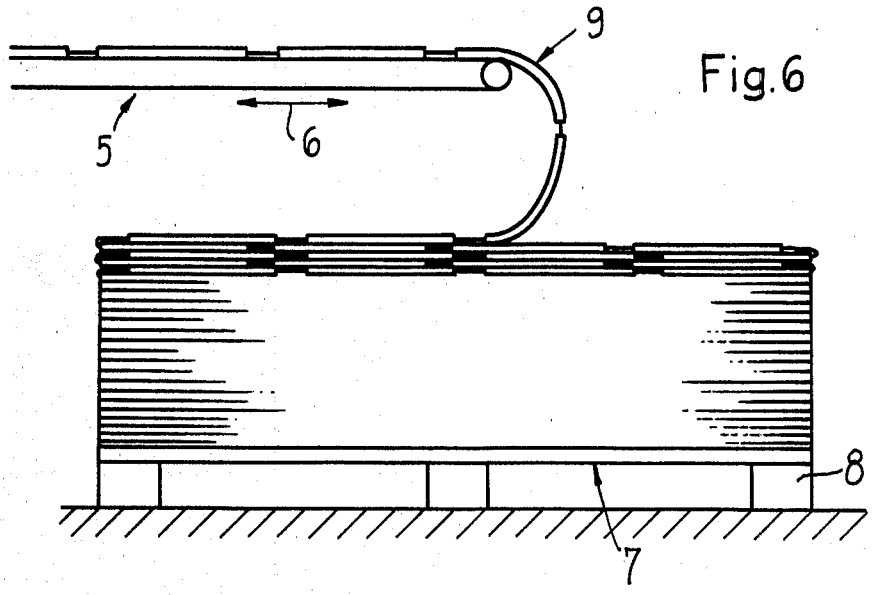
FIGS. 6 and 7 illustrate the stacking (or destacking) of printed products which are grouped together into the composite formation of the type here under consideration, wherein both of these figures show the devices used during such work operation and FIG. 6 additionally illustrates the formation of a multiple stack (palletizing)

Describing now the drawings, with the composite formation of products shown in FIGS. 1 and 2, the product copies 1 are engaged within cords or ropes 2 or the like. Such tying cords or ropes 2 are constituted by the traction or tension elements 3' and 3'', which extend along the composite formation and as generally indicated by reference character 4, are connected with one another between the product copies 1. Consequently, the mutual position of the product copies 1 is definitively fixed, and the spacing between the product copies—as will be recognized from the right-hand portion of FIGS. 1 and 2—need not in any way be constant, rather can vary in accordance with a specific law of conformity or regularity function. In this way it is possible to divide the composite formation into sections, which contain counted product copies or groups of product copies. The traction or tension elements 3' and 3'' can be formed by threads, cords, ropes, bands or the like, generically referred to herein as band or strap-like traction elements. They can be constituted by material which is used one time or, however, can be designed as accessory components which can be repeatedly reused. Particularly but not solely limited to the last-mentioned case, the connection between the traction elements can be a releasable connection, but of course also there can be conceived a connection which is effected by adhesive bonding or welding of the traction elements 3' and 3'' with one another.

An easily producible and equally easily detachable connection of the traction elements with one another will be seen by referring to FIGS. 4 and 5. Here, the traction elements, again conveniently designated by the reference characters 3' and 3'', are guided in a crossing fashion between groups of product copies 1, here each group being constituted by three product copies lying upon one another, and again such form tying means for the groups of product copies. The crossing of the traction elements can be accomplished by turning the product copies or the groups of product copies, and between neighboring product copies (or groups) there is accomplished a relative rotation amounting to at least 180°. By accomplishing a further relative rotation, it is possible for the crossing of the traction elements to assume the shape of a twisted arrangement. This is of course also then possible when there are used not only two, but a greater number of traction elements. On the other hand, it is completely conveivable to work with only one traction element, and such extends in loops in order to form a tying or wrapping arrangement, but however can also be provided with other means and coact therewith, which bring about the fixation of the product copies in relation to the traction elements in a form-locking or force-locking fashion.

As stated, during the building of a composite formation, it is immaterial whether there are grouped together individual product copies or groups of product copies. In the last-mentioned case, the product copies, as apparent from the showing of FIG. 3, also can be arranged in an imbricated fashion.

The composite formation, as will be evident from what has already been explained and readily recognized from the previously discussed figures of the drawing, can be folded between the product copies in such a manner that the composite formation assumes a shape or form which is comparable to that of endless or continuous forms as are frequently conventionally employed in offices. As particularly well seen by referring to FIG. 7, the fold zones or fields which are formed by folding and bearing against one another, can encompass only one product copy or a group of product copies or, however, as apparent from FIG. 6, a number of product copies or groups of product copies. The simple stack (FIG. 7) or multiple stack (FIG. 6) which is formed in this manner contains the product copies in an altered mutual position. The composite formation is however maintained, and therefore the product copies remain, as before, in a defined state. This will be apparent if there is conceived, apart from stacking, also the operation of mechanical destacking.

Figure 7:
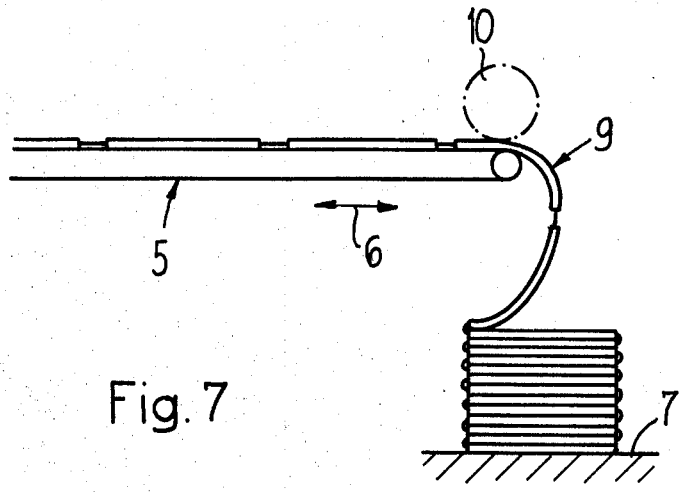

The stacking, in the broadest sense, and therewith also the palletizing, is accomplished according to the showing of FIGS. 6 and 7, with the aid of a device having an infeed element in the form of an endless revolving conveyor band or belt 5. As indicated by the arrow 6, this conveyor belt 5 is driven to move to-and-fro in the conveying direction with the aid of any suitable drive, above the stack support or support means 7 (in the showing of FIG. 6 such is constituted by a pallet 8) in order to thus deposit the composite formation in a meander-like fashion within the contour of the stack which is to be formed. The composite formation, generally designated by reference character 9, which is conveyed upon the conveyor belt 5, contains defined products, even though it is conveyed by frictional force. The same is then also applicable when the conveyor belt 5 is stopped and placed into operation so as to revolve in the opposite direction of movement. When there prevails an adequate frictional force or connection—as the same has been indicated in FIG. 7 by a contact or pressure roll 10—then there is carried out the actual destacking, in that the composite formation now conveyed in the opposite direction is withdrawn from the stack. As a result, there is formed the sequence of the product copies or groups of product copies, and there is assured that one product copy after the other or one group of product copies after the other follow one another and, specifically, in accordance with the preserved conformity law which, as will be recalled, is fixed right from the start and by the composite formation. Stated in another way, this means that the definition of the products again comes into play. What is worthy of comment in this respect is also the fact that upon seizing the composite formation it is already possible to gain handling control of all of the product copies, seized by such formation and in accordance with the product definition the products are under control and can be further handled. Apart from the previously mentioned possibility, there also can be realized numerous possibilities which heretofore were not even conceivable. Among them, by way of example and not limitation, is the possibility of storage in the broadest sense that this term is capable of use. This will be explained more fully hereinafter in the discussion of the operation occurring during stacking and palletizing in conjunction with the hereinafter given example.

It is generally conventional practice to print newspapers in a number of stages. The so-called pre-product is manufactured at random periods of time and then stored. The main portion of the newspaper containing the most current newsworthy items, departs from the rotary printing press at a later point in time shortly prior to delivery of the newspaper. This time stagger makes it necessary to bring together the main printed product copy for copy with the pre-products, meaning the auxiliary or secondary sections of the newspaper, which are stored in an intermediate storage. To this end, of course, it is necessary that previously the main printed products and the pre-products or pre-printed products are defined in the sense of the heretofore given explanations. If, however, at least the pre-printed products or pre-production is available as a composite formation, then it is possible to eliminate the difficult problems which then arise when stacked, palletized or merely stored pre-printed products are to be activated into their defined individuality and infed to a working process or step. This is even so when the total pre-production has been grouped together into a comprehensive composite formation or merely into a single composite formation. In reality, there are no limits as to the length of the composite formation. If there is kept in mind the production of the composite formation then this will be readily evident, since the product copies can be grouped together in random number and also random length into a composite formation. Even the storage operation does not constitute a limitation in terms of the processing procedure to the extent that the stacking operation also can be accomplished in a so to say "endless" or "continuous" fashion if the stack formation is carried out with sufficiently large stack supports. What is meant hereby is that, while staying with the previous example, the pre-production is not stored with the aid of pallets or the like, rather is infed as an "endless" composite formation into a storage area, which takes-up throughout its entire horizontal and vertical expanse the meander-like folded composite formation. Even if the storage area or compartment is located at a remote distance, charging and emptying thereof can be accomplished without any problems, provided that, and this is important to underscore, the definition of the products, both during storage and also upon removal out of such collecting storage, is maintained. The pre-printed products which are defined in this manner then can be discharged at a given, namely predetermined point in time from the composite formation and taken-over, depending upon the requirements, for carrying out the further processing operations or steps.

Figure 9:
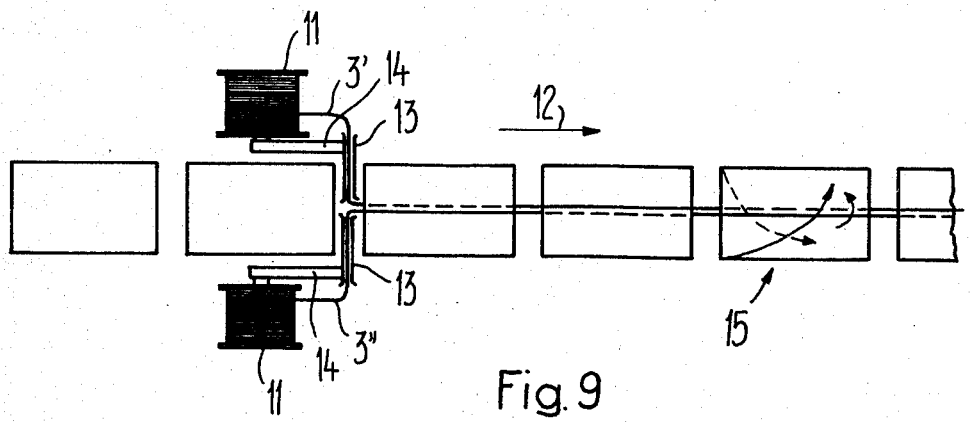

As already previously mentioned, it is possible to obtain an adequate definition of the product copies with the aid of a pair of traction or tension elements which bear against the serial row of product copies from the one or the other side thereof, as the case may be, and are passed to cross between the product copies. FIG. 9 illustrates equipment for producing such advantageous composite formation. Here, there are illustrated two spools 11, each containing a respective supply of traction elements 3' and 3''. For each of the traction elements 3' and 3'' there is provided a related guide element 13. After departure of the traction elements 3' and 3'' from their corresponding guide elements or guide means 13 these traction elements, in a manner still to be explained, are withdrawn in the direction of the indicated arrow 12. The guide elements 13 are movable in any convenient fashion transversely with respect to this withdrawal direction, in that for instance they are mounted in each case at a related pivotable arm 14, these pivotal arms 14 are each rotatably anchored at a not particularly referenced shaft which carries the corresponding spools 11. The pivotal arms 14 are driven to-and-fro by conventional drive means in opposition to one another and out of cycle, so that the guide means or elements 13, considered for themselves, carry out a to-and-fro movement transversely with respect to the withdrawal direction and thus, in opposition to one another. The printed products themselves are infed by any suitable conveyor device in the direction of the arrow 12 to the equipment, and the arrangement is structured such that the guide means 13 during such time as they "change their position" each pass through the gap between two product copies wherein, of course, there can also be meant groups of product copies. Hence, the traction elements 3' and 3'' alternately come to lie at the lower and upper side of the successive product copies, after they have crossed-over each time at the gap between two product copies. This process can be readily compared with what happens during weaving of a loom. This is particularly then evident if one or a number of further pairs of guide elements or guide means 13 are arranged in the withdrawal direction 12 and, starting from both traction elements extending at the lengthwise central region, in other words along the central line of the composite formation, there are withdrawn to the one or the other side, as the case may be, further traction elements and are brought into play analogous to the first traction elements. These additional or further traction elements of course must be paid-off from their own supply. The withdrawal of the traction elements, in all cases, can be accomplished in that the product copies are themselves conveyed or further conveyed, as the case may be. By turning the product copies it is possible to accomplish the crossing of the traction elements in the sense of twisting the same, as generally indicated by reference character 15.

Figure 8:
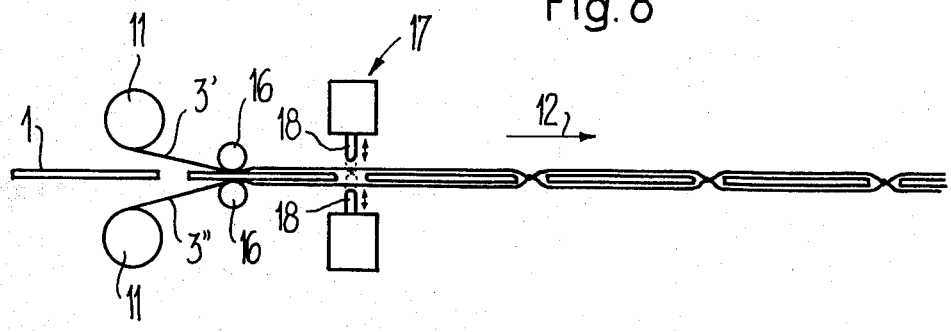
FIGS. 8 and 9 show a respective apparatus during the building of a composite formation formed of individual product copies, wherein certain parts of the equipment have not been shown or only indicated by functional symbols in order to simplify the illustration.

When the embodiment of the equipment shown in FIG. 8, the traction elements 3' and 3'' are likewise withdrawn from their supply spools 11 or equivalent structure which, however, in this arrangement, are dispositioned at the upper or lower side, respectively, of the infeed track or path of travel of the product copies 1. With the aid of rollers or rolls 16, the traction elements are caused to contact the one or the other side of the product copies. They are again then withdrawn in the direction of the arrow 12. In this regard, there is analogously applicable the observations which have been previously made in the prior description. Viewed in the direction of withdrawal there is arranged following the rolls 16 a welding device (or adhesive bonding device) 17, containing opposite and out of phase driven punches 18. The arrangement is accomplished such that the punches 18 in each case impact against one another at the region of a gap between the product copies, in order to thus connect the traction elements 3' and 3'' with one another, either by adhesive bonding, welding or any other equivalent attachment mode.

The equipment of FIG. 9 can be driven in the reverse work sense than previously described, in which case the composite formation moved opposite to the direction of the illustrated arrow 12, is then "unwoven" and thus, eliminated. These measures enable the repeated use of the traction elements. On the other hand, certain advantages are realized when the product copies are retained for as long as possible in their composite formation or array, this also then being true when the product definition is not or no longer important. In fact, stacks formed of composite formations, and in this respect attention is directed to FIGS. 6 and 7, are in any case much more stable, since the product copies do not bear against one another loosely, rather are interconnected with one another. Such stacks therefore can be individually or in palletized form easily and rapidly transported. Therefore, it is conceivable, and under circumstances even advantageous, to retain the composite formation for as long as possible, even during the delivery of the products. It is possible to easily eliminate the traction elements, which then are only used one time, in other words are disposable traction elements, particularly if the same are thread or rope-like elements. In this way the otherwise required tying operations at least can be partially dispensed with.

While there are shown and described present preferred embodiments of the invention, it is to be distinctly understood tht the invention is not limited thereto, but may be otherwise variously embodied and practiced within the scope of the following claims. Accordingly,

What is claimed is:

1. A method of manipulating printed products, especially newspapers or magazines or the like, comprising the steps of:

arranging product copies or groups of product copies in a serial row for forming a composite formation;

interconnecting the product copies or groups of product copies with one another into a band, worm-like, foldable structure, defining the composite formation by coherent tying means which engage about the product copies or groups of product copies;

forming the tying means by means of at least two traction elements extending in the length of the composite formation;

supplying from the one or the other side each of said traction elements;

passing the traction elements in a crossing fashion between the product copies or groups of product copies;

interconnecting the traction elements with one another between the product copies or groups of product copies; and processing the folded structure in such composite formation.

2. The method as defined in claim 1, further including the steps of:

crossing the traction elements by carrying out relative rotation of the product copies or groups of product copies.

* * * * *